United States Patent [19]

Dentith

[11] Patent Number: 4,972,590

[45] Date of Patent: Nov. 27, 1990

[54] KNITTING GUIDE

[76] Inventor: Edward J. Dentith, 64 Victoria Avenue, Barrow-in-Furness, Cumbria LA14 4LA, England

[21] Appl. No.: 493,849

[22] Filed: Mar. 15, 1990

[51] Int. Cl.[5] ..... G01B 3/00

[52] U.S. Cl. ..... 33/1 K; 33/430

[58] Field of Search ..... 434/95; 33/1 BB, 1 K, 33/1 R, 1 C, 430, 443; 116/235, 325, 240; 40/352

[56] References Cited

U.S. PATENT DOCUMENTS 3,328,899 7/1967 Stewart ..... 116/240 X 4,672,747 6/1987 Turner ..... 33/1 K

*Primary Examiner*—Harry N. Haroian

*Attorney, Agent, or Firm*—Leon Gilden

[57] ABSTRACT

A device including a support base mounting a transparent plate thereon is provided wherein a pattern for knitting is secured between the transparent plate and the base. The base includes spaced upstanding wall bars wherein a left bar includes a lineal measuring gauge and the right bar includes a plurality of gauges and an associated slide for each gauge for accounting of the number of rows in a knitting procedure as well as the associated pattern utilized in a particular knitting procedure. The plate is secured within the base by a plurality of forward corner braces and rearwardly by utilizing fasteners directed through apertures formed within the plate received within the base. Further, a sliding gauge is slidedly mounted overlying the plate for effecting a counting of stitches utilized within a knitting operation. A modified plate member includes a plurality of fiber optic transmission lines and an associated illumination source mounted to the base for illumination of the plate during periods of limited light conditions.

6 Claims, 4 Drawing Sheets

PRIOR ART

STITCHES
ROWS
PATTERNS
11
12
13
14
14a
14b
15
16
17
18
21
22
23
24
25
26
27
28
29
30
31
32

KNITTING GUIDE

BACKGROUND OF THE INVENTION

1. Field of the invention

The field of the invention relates to knitting gauges, and more particularly pertains to a new and improved knitting guide wherein the same permits securement of an associated pattern between a base and an overlying support plate as well as utilizing accounting gauges keeping track of the patterns, stitches, and rows utilized in a knitting procedure.

2. Description of the Prior Art

The use of gauge apparatus has in the prior art been available to secure various patterns in a knitting procedure. Due to the relatively complex nature of a knitting procedure, in order to prevent an individual from skipping rows or stitches, a gauge is extremely useful in enhancing an individual's efficient and effective culmination of a knitting procedure.

Examples of the prior art include U.S. Pat. No. 4,391,591 to HAMBURGER utilizes a support plate utilizing a clip to secure a pattern underlying the clip the sliding gauge overlying the pattern mounted on the support plate.

U.S. Pat. No. 2,722,814 to FERLAZZO provides for a bar with a plurality of spaced parallel slots therethrough to direct a knitting graph through the bar with slidable members in surrounding relationship relative to the bar to maintain the graph in a desired position relative to the bar.

U.S. Pat. No. 2,301,410 to KAPLAN et al set forth a crochet pattern device wherein a pattern is mounted on a plate with a bar slidably mounted overlying the pattern that accommodates an individual involved in a crocheting procedure.

U.S. Pat. No. 457,166 to OLSSON sets forth a knitting indicator utilizing a plurality of pattern cards and an associated gauge for indicating the number of rows and patterns to be accommodated by the individual involved in a knitting procedure.

U.S. Pat. No. 4,259,784 to MACPHERSON provides a slide overlying a graph to selectively modify portions of the underlying graph paper for production of a square by square onto a material compartmentalized to receive the graphic presentation.

Accordingly, it may be appreciated that there continues to be a need for a new and improved knitting guide as set forth by the instant invention which addresses both the problems of ease of use as well as effectiveness in construction enhancing the ease by which an individual accommodates and maintains track of a knitting procedure and in this respect, the present invention substantially fulfills this need.

SUMMARY OF THE INVENTION

In view of the foregoing disadvantages inherent in the known types of knitting guides now present in the prior art, the present invention provides a new and improved knitting guide wherein the same utilizes a transparent plate overlying a knitting pattern and associated gauges to maintain counting of the various rows, stitches, and pattern utilized in the knitting event. As such, the general purpose of the present invention, which will be described subsequently in greater detail, is to provide a new and improved knitting guide which has all the advantages of the prior art knitting guides and none of the disadvantages.

To attain this, the knitting guide of the instant invention essentially includes a device including a support base mounting a transparent plate thereon is provided wherein a pattern for knitting is secured between the transparent plate and the base. The base includes spaced upstanding wall bars wherein a left bar includes a lineal measuring gauge and the right bar includes a plurality of gauges and an associated slide for each gauge for accounting of the number of rows in a knitting procedure as well as the associated pattern utilized in a particular knitting procedure. The plate is secured within the base by a plurality of forward corner braces and rearwardly by utilizing fasteners directed through apertures formed within the plate received within the base. Further, a sliding gauge is slidedly mounted overlying the plate for effecting a counting of stitches utilized within a knitting operation. A modified plate member includes a plurality of fiber optic transmission lines and an associated illumination source mounted to the base for illumination of the plate during periods of limited light conditions.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, not is it intended to be limiting as to the scope of the invention in any way.

It is therefore an object of the present invention to provide a new and improved knitting guide which has all the advantages of the prior art knitting guides and none of the disadvantages.

It is another object of the present invention to provide a new and improved knitting guide which may be easily and efficiently manufactured and marketed.

It is a further object of the present invention to provide a new and improved knitting guide which is of a durable and reliable construction.

An even further object of the present invention is to provide a new and improved knitting guide which is susceptible of a low cost of manufacture with regard to both materials and labor, and which accordingly is then susceptible of low prices of sale to the consuming public, thereby making such knitting guides economically available to the buying public.

Still yet another object of the present invention is to provide a new and improved knitting guide which provides in the apparatuses and methods of the prior art some of the advantages thereof, while simultaneously overcoming some of the disadvantages normally associated therewith.

Still another object of the present invention is to provide a new and improved knitting guide which may be compactly stored when not being utilized.

Yet another object of the present invention is to provide a new and improved knitting guide wherein the same securably clamps a pattern between a transparent plate and underlying support base and further provides for various gauges to maintain accounting of the various procedures utilized in a knitting event.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
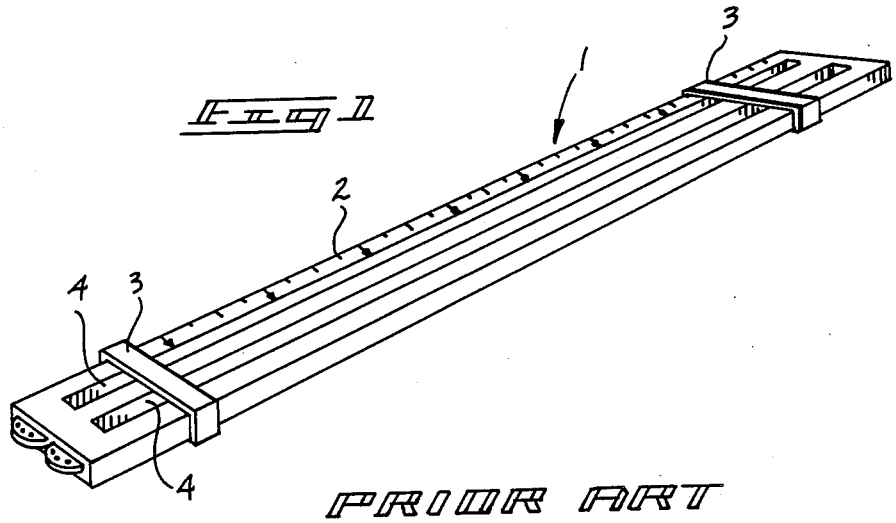
FIG. 1 is an isometric illustration of a prior art knitting guide.

With reference now to the drawings, and in particular to FIGs. 1 to 7 thereof, a new and improved knitting guide embodying the principles and concepts of the present invention and generally designated by the reference numeral 10 will be described.

Figure 2:
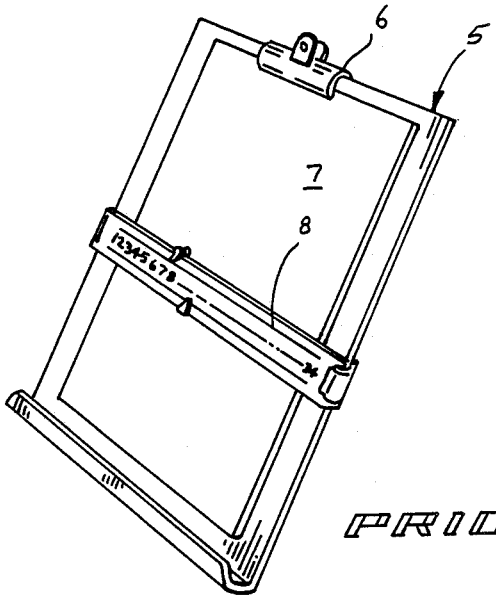
PRIOR ART FIG 2
FIG. 2 is an isometric illustration of a further prior art knitting guide.
Figure 3:
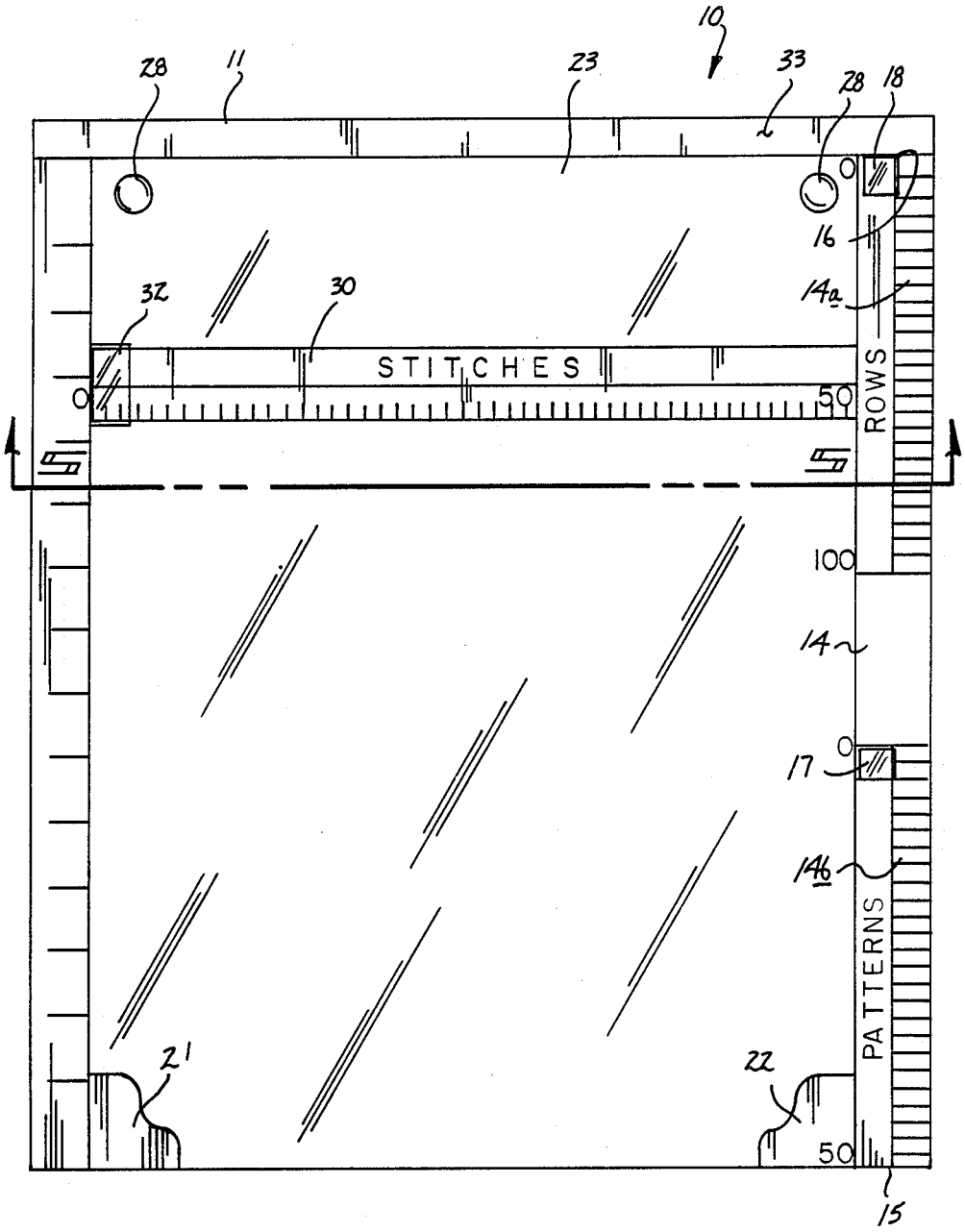
FIG. 3 is a top orthographic view of the instant invention.
Figure 4:
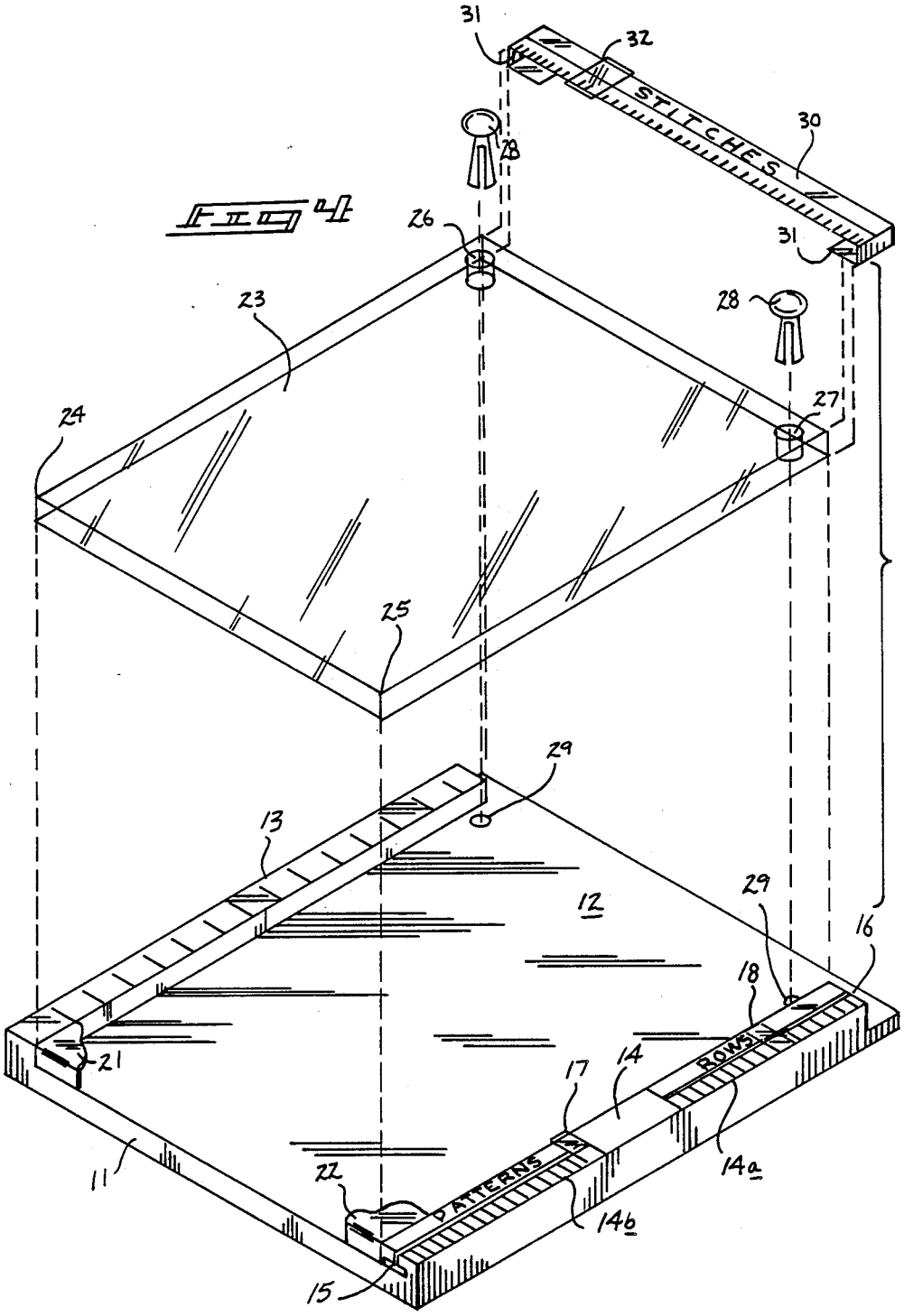
FIG. 4 is an exploded isometric illustration of the instant invention.
Figure 5:
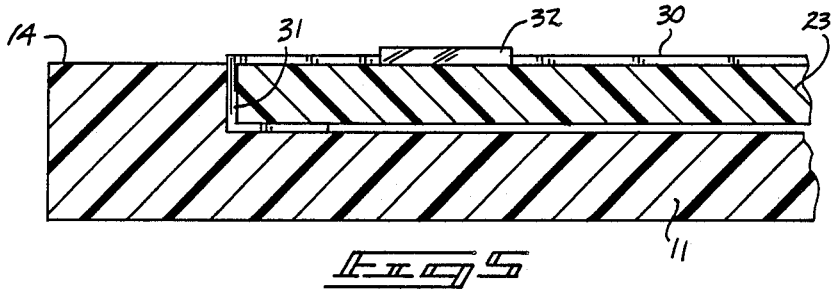
FIG. 5 is a partial sectional view taken along the lines 5—5 of FIG. 3 in the direction indicated by the arrows.

FIG. 1 illustrates a typical prior art knitting guide 1 including a bar 2 with a plurality of parallel slots 4 directed therethrough wherein a pattern graph paper is directed in a serpentine manner through the parallel slots wherein the slide bar 3 slidably mounted in surrounding relationship relative to the bar are directed interiorly against sides of the paper to frictionally engage and clamp the paper in a predetermined orientation relative to the bar. FIG. 2 illustrates a further prior art knitting guide 5 wherein a clamp 6 secures a pattern 7 overlying an underlying support plate with a slidable gauge 8 slidable overlying the pattern to accommodate and account for knitting characteristics in the particular knitting of the underlying pattern 7.

More specifically, the knitting guide 10 of the instant invention essentially comprises a elongate generally rectangular support base 11 defined by a planar central support table 12 with a spaced first and second bar 13 and 14 arranged parallel to one another and opposed sides of a support table 12. The first bar includes a lineal measuring gauge 13 coextensive therewith formed an upper surface thereof for effective measurement of a knitting pattern (not shown) positionable on the table 12. The second bar 14 includes a plurality of gauges including a "row gauge" **14*a* spaced from a "pattern gauge" 14*b* each of the row gauge and pattern gauge 14*a* and 14*b* respectively include a respective first and second T-slot 15 and 16 coextensively directed through a top surface of the second bar 14 coextensive with the respective row and pattern gauges. A first slide 17 and a second slide 18 are slidably mounted within the respective first and second T-slots 15 and 16 for orienting the slides in association with respective marking or indicia of each of the row and pattern gauges in accordance with a row of a knitting work piece and indication of the pattern utilized of that particular work piece in reference to the pattern positioned upon the support table 12. A first and second V-shaped corner support 21 and 22 defines a first and second V-shaped cavity as each of the corner supports are mounted onto the support table 12 adjacent lower-most ends of the first and second bars 13 and 14. The V-shaped cavities receive a transparent rectangular plate 23. The support table 12 is formed of an opaque material and is visible through the transparent rectangular plate 23 mounted thereon. The rectangular plate 23 extends from the lower-most edge of the table 12 between the first and second bars 13 and 14 coextensive therewith and terminates in upper terminal ends of the respective first and second bars 13 and 14 providing a support base ledge 33 extending beyond the first and second bars illustrated in FIGS. 3 and 4. Securement of the transparent, rectangular plate 23 is finally effected utilizing lock pins 28 directed through associated first and second cylindrical bores 26 and 27 formed through aligned upper corners of the transparent plate 23 with the lock pins 28 receivable within respective support base cylindrical bores 29 aligned with the first and second cylindrical bores 26 and 27 when the transparent plate 23 is mounted upon the support table 12**.

A planar guide rule 30 is slidingly mounted orthogonally between the first and second bars 13 and 14 overlying the transparent rectangular plate 23 to effect indication of stitches utilized in a knitting event. The guide rule 30 includes a third slide 32 slidably mounted thereover to indicate the number of stitches utilized in a knitting event wherein each of the slides 17, 18, and 32 utilized with a respective row gauge **14*a*, pattern gauge 14*b*, and guide rule 30** are transparent for visual observation of the underlying indicia.

The guide rule 30 is formed with L-shaped end portions 31 to overly the rectangular plate 23 and thereby capture the guide rule 30 when the transparent plate 23 is mounted on the table 12. The L-shaped end portions 31 include a leg underlying and parallel to the overlying guide rule 30.

Figure 6:
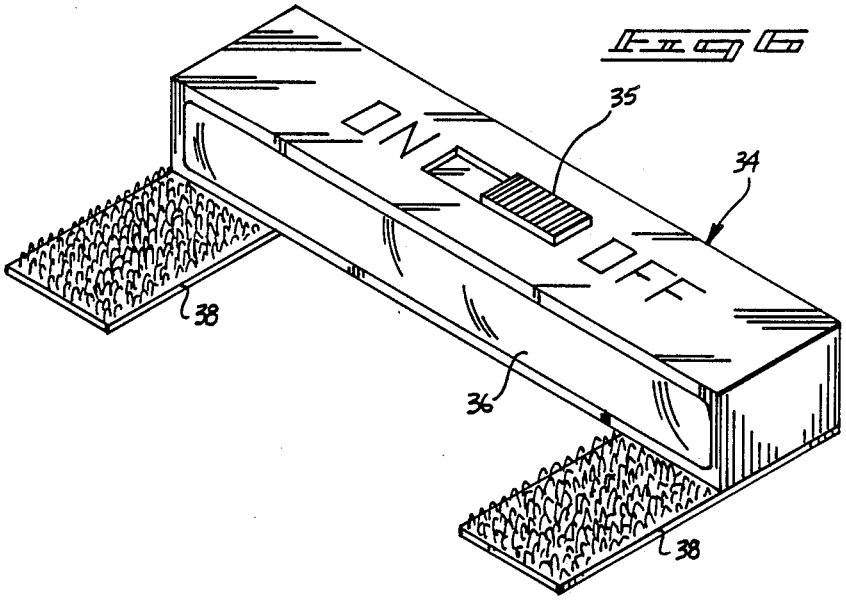
FIG. 6 is an isometric illustration of illumination member utilized by the instant invention.
Figure 7:
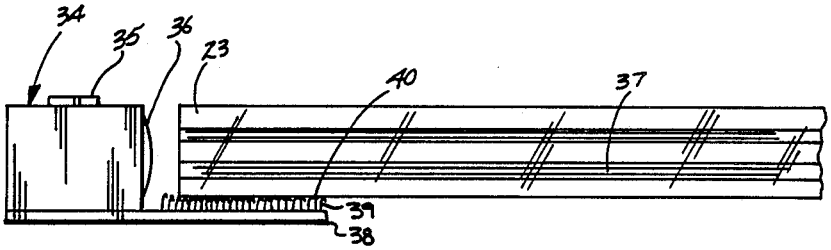
FIG. 7 is an orthographic side view taken in elevation of the illumination member in association with the support plate of the instant invention.

The support base ledge 33 is utilized in combination with an illumination housing 34 mounted thereon. The illumination housing as illustrated in FIG. 6 includes an on-off switch 35 with an elongate light source 36 coextensive with the support ledge 33 of a length defined between the first and second bars 13 and 14. The illumination housing 34 includes a plurality of flexible straps 38 formed with first hook loop fasteners 39 mounted thereon cooperative with second hook loop fasteners 40 formed to a lower forward bottom surface of the plate 23. The plate 23 further includes a plurality of fiber optic lines 37 directed therethrough in a predetermined configuration to provide illumination of the first and second bars 13 and 14 as well as the underlying pattern in use to enhance illumination of the pattern and associated rules when utilized in areas of limited light.

As to the manner of usage and operation of the instant invention, the same should be apparent from the above disclosure and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A knitting guide apparatus securing a pattern to be followed, the apparatus comprising, a support base, the support base including a planar support table top surface, the table top surface bounded by a first bar and second bar orthogonally and integrally mounted to support base on opposed sides of support base with the table surface directed therebetween, and the first bar including a first gauge, and the second bar including a second and a third gauge, and a transparent rectangular plate securable onto the table top surface for securing a pattern to be followed between the table top surface and the transparent rectangular plate, and wherein the first gauge includes lineal measuring gauge including indicia formed thereon coextensive with an upper surface of the first bar, and the second gauge includes a row gauge for indication of a row to be knitted in a knitting procedure, and the third gauge formed on the second bar in alignment with the second gauge includes a series of indicia for indicating a pattern to be followed, and the row gauge and the pattern gauge including a "T" slot coextensively formed therewith and directed through the second bar, the "T" slot of the second and third gauge slidably receiving a respective first and second transparent indicator slidable therewithin overlying the row gauge and pattern gauge.

2. Apparatus as set forth in claim 1 wherein the transparent rectangular plate includes a fourth gauge, the fourth gauge slidably mounted on the transparent rectangular plate including L-shaped end portions overlying end surfaces of the rectangular plate, and a third transparent indicator slide slidably mounted over the fourth gauge, the fourth gauge including a series of indicia coextensive therewith for indicating a predetermined number of stitches associated with a knitting event.

3. Apparatus as set forth in claim 2 wherein the support base includes a first and second generally V-shaped corner support, each V-shaped corner support mounted adjacent a lower-most terminal end of the first and second bar overlying the table top surface defining a respective first and second V-shaped cavity therewithin for slidably receiving opposed lower terminal end corner portions of the associated transparent rectangular plate.

4. Apparatus as set forth in claim 3 wherein transparent plate includes a plurality of spaced through extending plate apertures, and the support base includes a plurality of support base cylindrical bores in alignment with the plate bores in coaxial alignment therewith when the transparent plate is mounted on the lower top surface and positioned within the first and second L-shaped corner supports.

5. Apparatus as set forth in claim 4 including a lock pin directed through each plate bore and base bore to lock the plate relative to the base when the lock pins are directed and received within respective plate bore and base bore.

6. Apparatus as set forth in claim 5 further including an illumination housing, the illumination housing includes an elongate illumination member coextensive with an upper terminal edge of the transparent plate and aligned therewith and when the illumination housing is mounted on the support base adjacent the upper terminal end of the transparent plate, and an on-off switch for selective actuation of the illumination member, the illumination member in alignment with the upper terminal edge of the transparent plate, and the transparent plate including a plurality of fiber optic lines directed therethrough for illumination of the first, the second, and third gauges and the lower top surface.

* * * * *